United States Patent [19]

Terry

[11] 3,995,464

[45] Dec. 7, 1976

[54] DOOR LOCKING MEANS

[75] Inventor: Raymond Kenneth Henry Terry, Mayland, England

[73] Assignee: W. J. Reynolds (Equipment) Limited, England

[22] Filed: Mar. 24, 1975

[21] Appl. No.: 561,575

[52] U.S. Cl. ..... 70/434; 70/DIG. 49

[51] Int. Cl.[2] ..... E05B 39/04

[58] Field of Search ..... 70/431, 432, 434, 435, 70/441, DIG. 49, 277–283; 292/21, 41, 92

[56] References Cited

UNITED STATES PATENTS 3,599,454 8/1971 Hill ..... 70/265

*Primary Examiner*—Robert L. Wolfe

*Attorney, Agent, or Firm*—William Anthony Drucker

[57] ABSTRACT

The invention relates to a door-locking and release system in a building in which system a door is adapted to be held locked by a component removably affixed thereto. Said component is adapted to operate an electrical circuit, such as to deactivate off an alarm circuit, only when detached from the door to provide an indication that the door is in the unlocked condition.

12 Claims, 6 Drawing Figures

DOOR LOCKING MEANS

This invention relates to door-locking means, and is concerned with the locking and unlocking of doors in large buildings to which the public has access, e.g. multiple stores, supermarkets, cinemas and the like.

In many areas, regulations, e.g. fire regulations, imposed by central or local government authorities require that doors leading out of the building shall be open, or easily openable from inside the building, as long as the building is in use by the public for its intended purpose. On the other hand it is clearly necessary that the doors shall be closed and locked when the building is not in use, as a safeguard against pilfering or theft, and there is a danger that when the building is re-opened, after such closure, individuals responsible may forget or fail to open or unfasten all the doors, and thus establish dangerous conditions in breach of the regulations.

The object of the present invention is to provide means which will eliminate or reduce the risk of failure to open the doors, as required by the regulations, in the manner indicated above, and with this end in view the invention consists in a door-locking and -release system in a building wherein a door is adapted to be held locked by a component removably affixed thereto, which component is adapted to operate an electrical circuit inside the building and must be detached from the door to perform that function.

The electrical circuit can be constituted by, for example, the lighting circuit in the building whereby said lighting circuit cannot be completed until a said component removed from the door is applied to a nearby fitting in the circuit. However, it is preferred that the electric circuit is an alarm circuit, especially one which operates only when a lighting circuit in the building is completed.

According to a preferred embodiment of the present invention therefore, there is provided a door-locking and release system in a building wherein a door is adapted to be held locked by a component removably affixed thereto, which component is adapted to operate an alarm circuit inside the building and must be detached from the door to perform that function.

It will be appreciated that the alarm circuit usually is completed (i.e. in an alarm-giving condition) when the component or, in the case of several doors associated with the same alarm circuit, any one or more of the component is still affixed to the door in a locking position. Only when the or each component is removed from its locking position on the door can the alarm circuit normally be broken (i.e. in a silent or non-alarm-giving condition). The alarm circuit may be activated in any suitable way but preferably by an operation, especially switching on of a lighting circuit, which is consistently performed on or shortly after opening the building. The alarm circuit may, for instance, be activated by switching on of a light switch, unlocking an internal door in the building such as the door to a particular office or simply by depressing a switch suitably located by an alarm device of the circuit.

The alarm device of the circuit can provide an audible warning, such as by means of an electric bell, and/or a visual warning such as by means of an indicator light or display of indicating lights. It is preferred that, when more than one door is associated with the alarm circuit, the alarm device should indicate which door component or components are absent from their circuit operating positions; a display of indicator lights is particularly suitable for such purposes.

The invention will be clearly understood from the following description of one form (given, however, merely by way of example) which it may assume, and this description will be more readily followed by reference to the drawings accompanying this Specification, wherein FIGS. 1 and 2 represent in front elevation and plan respectively doors fitted with locking means in accordance with the invention;

Figure 1:
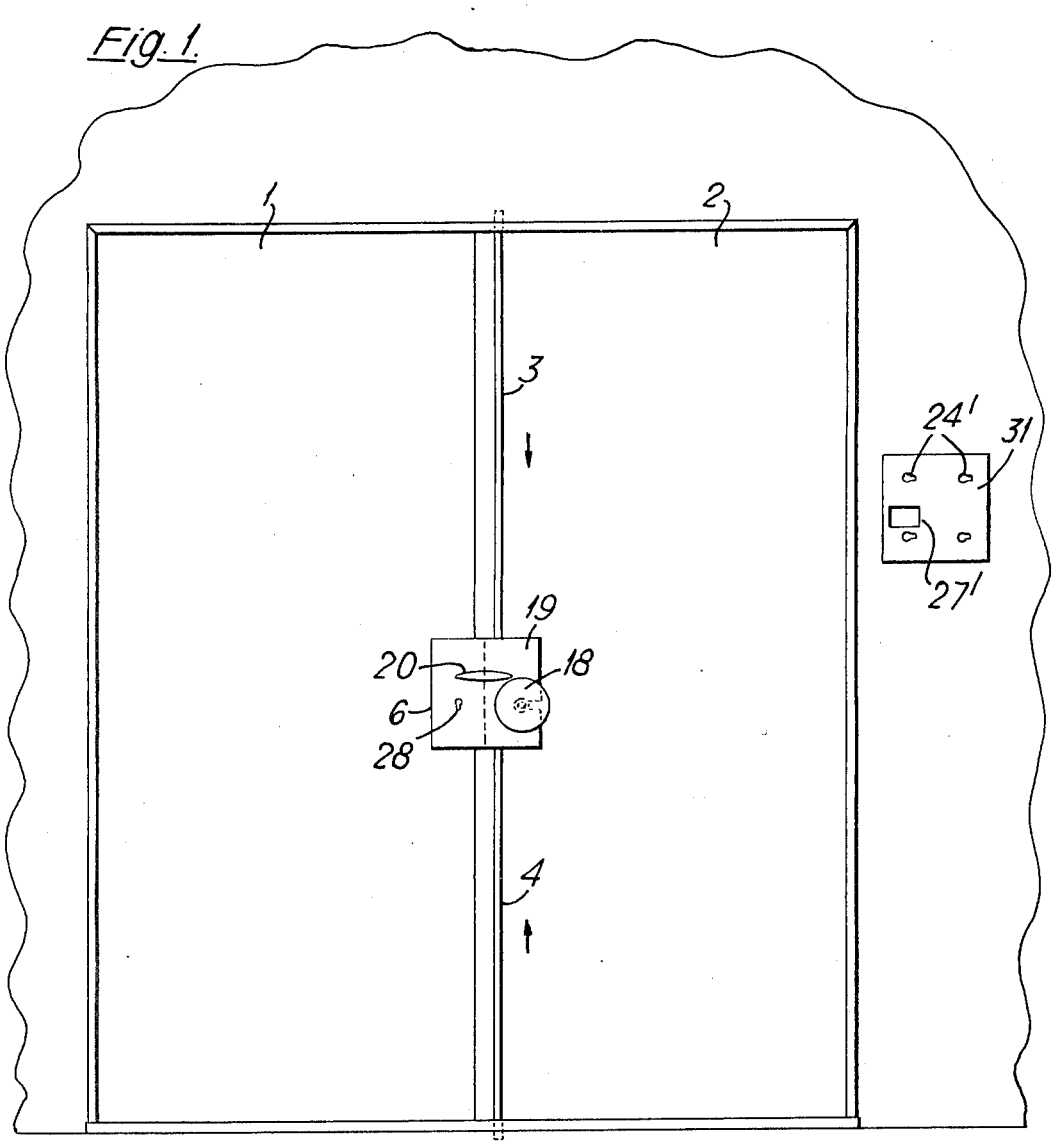
Figure 2:
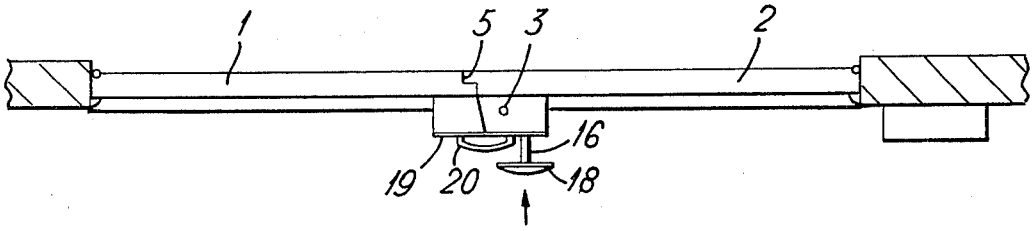
Figure 3:
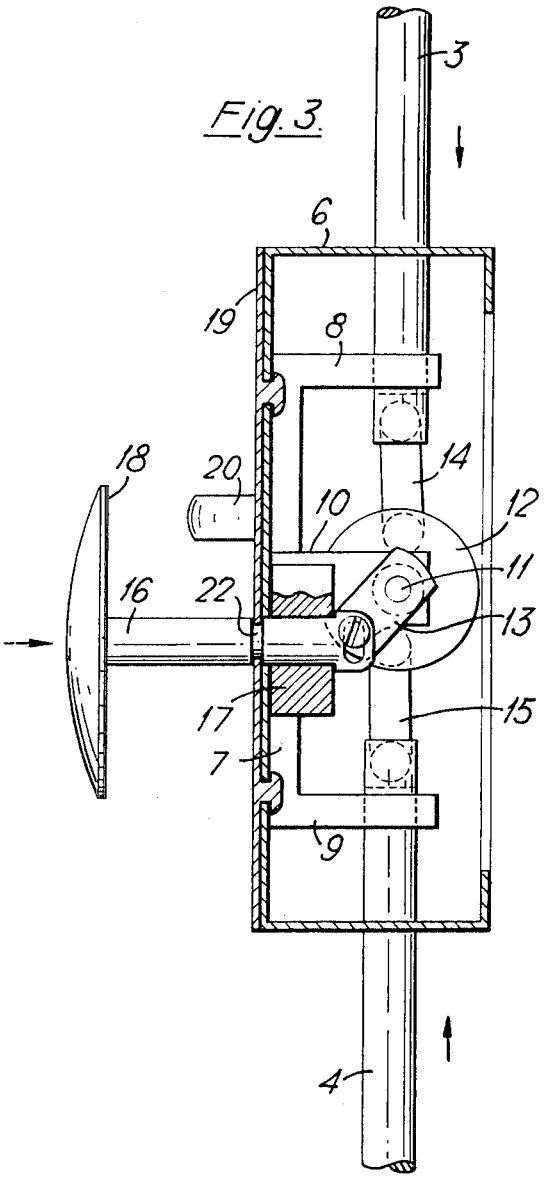
FIG. 3 represents in enlarged side sectional elevation the locking mechanism fitted to the doors shown in FIG. 1.
Figure 4:
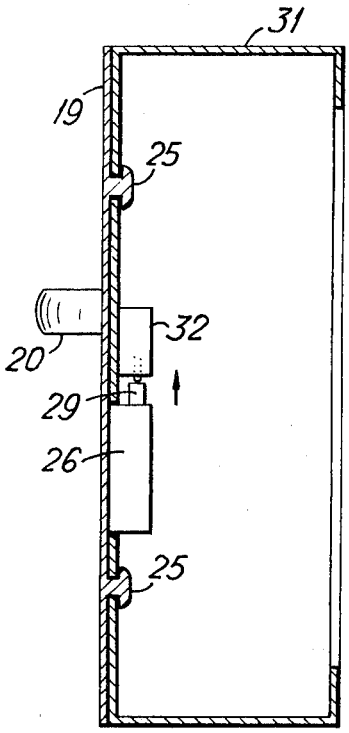
FIG. 4 represents a like view of an enclosure mounted in the vicinity of the doors.
Figure 5:
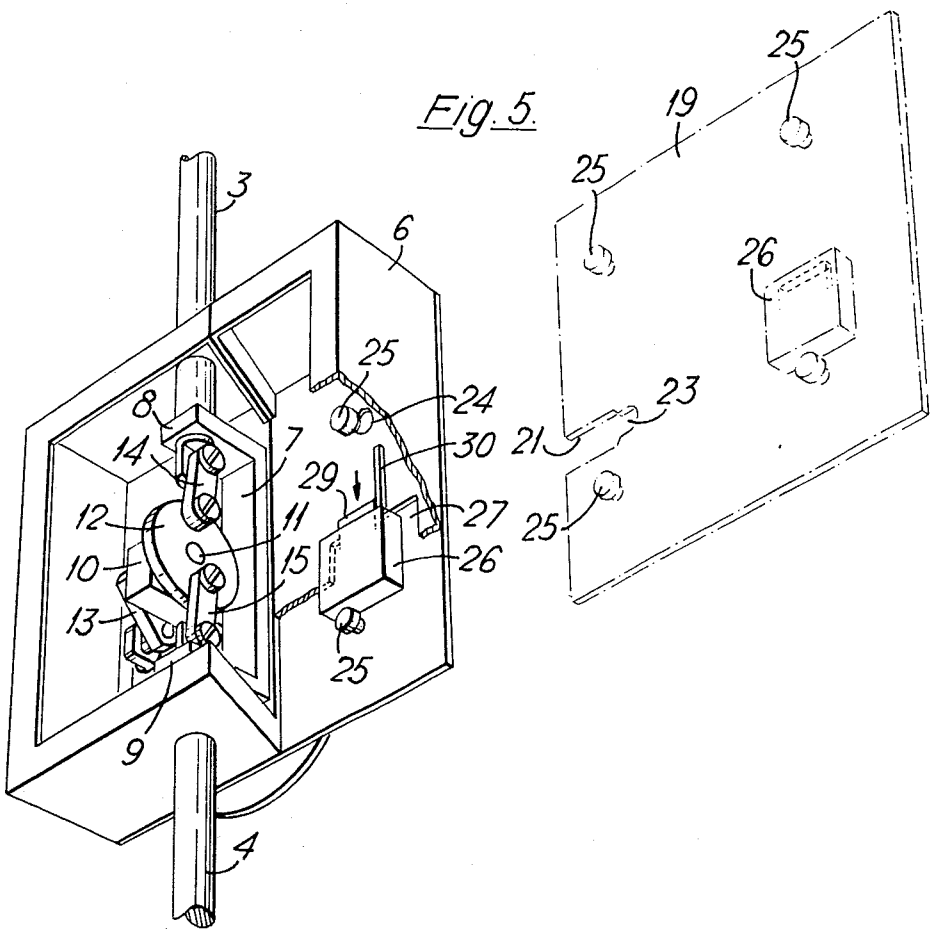
FIG. 5 represents a rear perspective view, partly broken away of the case and mechanism shown in FIG. 3.
Figure 6:
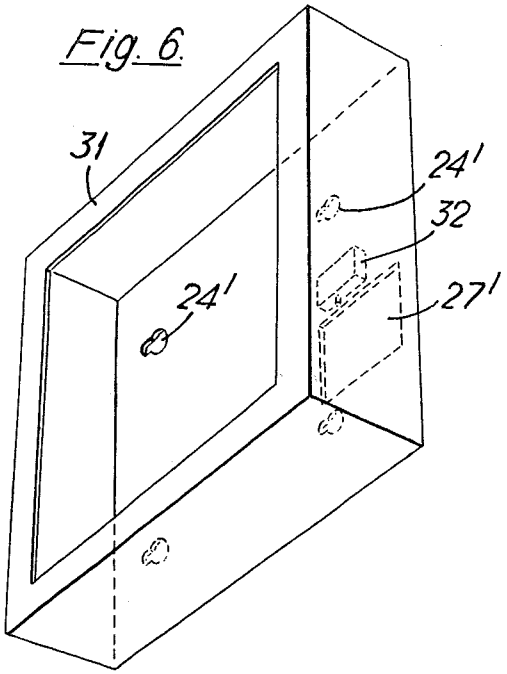
FIG. 6 represents a like view of the enclosure shown in FIG. 4.

In carrying the invention into effect in one convenient manner, as shown in the aforesaid drawings, when applied to double doors 1, 2 adapted to swing outwardly to serve as an exit from a large public building such as a supermarket or a cinema, one of said doors is provided with vertically reciprocable "panic bolt" rods 3, 4 which when extended, while the doors are closed, engage in sockets in the door frame to lock the door, which holds the other door firmly closed by rabbet engagement 5 of their contacting vertical edges. The bolts 3, 4 are movable in opposite directions by mechanism housed in a box-like casing 6 mounted at a suitable height adjacent to the edge of the door 2 carrying the bolts 3, 4, inside the door.

The mechanism may be of any convenient form, and in the construction illustrated comprises a U-shaped bracket 7, welded to the inner face of the front wall of the casing 6, having upper and lower arms 8, 9 in which are slidably mounted the bolts 3 and 4 respectively, which bolts extend through apertures in the top and bottom walls of the casing. A side arm 10 projects from the mid-point and at one side of the U-shaped bracket 7. A shaft 11 rotatable in the side arm 10 carries at its inner end a disc 12 and at the other end alever 13. The bolts 3 and 4 are connected by links 14, 15 respectively to diametrically opposite points of the disc 12. To the free end of the lever 13 is attached the inner end of a rod 16, slidably mounted in a bearing block 17 welded to the inner surface of the front wall of the casing 6, this rod 16 projecting through an aperture in the casing wall, and terminating in a large-diameter domed head 18. Pulling and pushing the head 18 and rod 16, rotates the disc 12 and causes the bolts 3 and 4 respectively to extend or retract in relation to the casing 6, and thus to engage in or disengage from the frame sockets whereby to lock or release the door respectively.

In order to lock the doors means are provided to prevent reciprocation of the rod 16. In one convenient form such means comprise a metal plate 19 of substantially the same size and shape as the front wall of the casing 6, and provided on its outer face with a grip or handle 20. At a suitable point in one edge this plate 19 is formed with a slot 21 of sufficient width to slide on to the rod 16. At a point just outside the casing 6 when the rod 16 is fully withdrawn from the casing (and thus when the bolts 3 and 4 are extended to secure the door), the rod is grooved, as at 22, to be of reduced diameter, and the slot 21 of plate 19, at its inner end is reduced, as at 23, to engage the slotted portion 22 of the rod 16. Thus when the plate is fitted to the front of the casing 6, while the rod 16 is fully withdrawn, and moved to a position where the slot 23 engages the groove 22, the rod 16 is held immobile, and the bolts 3 and 4 are held in their door securing positions. The front wall of the casing 6 is formed with keyhole apertures 24, and the inner face of the plate 19 is provided, in corresponding positions, with headed pins 25 to engage the apertures 24 and thus secure the plate 19 to the front of the casing 6. The inner face of the plate 19 is also fitted with a lock 26, and the front wall of the casing 6 is formed with an aperture 27 through which the lock 26 projects into the casing when the plate 19 is secured to the front thereof. The lock 26 may be operated by a key through a keyhole 28 in the plate 19, and the bolt 29 of the lock 26, when extended, projects behind the front wall of the casing. It also projects beside an abutment 30 on the inner face of the casing wall, thus preventing sideways movement of the plate 19 necessary for detachment from the casing. Thus the doors are held firmly locked by the bolts 3 and 4, immobilised by the mechanism described, until the lock 26 is released and the plate 19 disengaged from the casing 6.

According to the invention, mechanism necessary to operate the alarm circuit in the building is the plate 19 and its associated parts.

In the arrangement being described there is mounted adjacent to the doors 1, 2 (e.g. on the interior of the building wall) a box-like casing 31, substantially identical with the casing 6 and provided with keyhole apertures 24$^1$ and an aperture 27$^1$ (corresponding to apertures 24 and 27 in casing 6) to receive the headed pins 25, and the lock 26 respectively of the plate 19. Internally of the front wall of the casing 31 adjacent to the lock aperture 27$^1$ is a microswitch 32 in a position to be activated by the bolt 29 of the lock 26 when the plate 19 is fitted to the front of the casing 31, and the key turned in the lock. The switch 32 when activated energises a relay (not shown) in the casing 31 which breaks an alarm circuit, which circuit is itself energised when a main switch in the lighting circuit is turned on.

It will be appreciated that when the plate 19 is removed from the casing 31, the alarm circuit is completed and this condition prevails while the plate is in use to lock doors 1 and 2. Since the alarm circuit is energised by turning on the main lighting switch, power will be supplied to an alarm device (not shown) located remote from the door causing that device to operate. In the present system being described, the alarm device is a warning light on a central board in an office, for example a manager's office. When the completed circuit is energised as described above, the light will be illuminated indicating that the plate 19 is not located in casing 31 and is most likely still in a locking position on doors 1 and 2.

When a building is provided with a plurality of doors each of all but one is preferably fitted with the internal locking arrangements described above, and with a casing 31 housing switch means in the alarm circuit, and the switch means of all these cases would be connected in parallel to ensure that all of the aforementioned doors are released before the alarm device when energised is silent (i.e. not illuminated). The one remaining door would be provided with locking means openable by, for example, a key, from the outside to allow access to a person responsible for opening up the building.

It should be understood that the invention is not limited solely to the details of the form described above, which may be modified, in order to meet various conditions and requirements encountered, without departing from the scope of the invention.

What is claimed is:

1. In a door-locking and release system in a building wherein a door is adapted to be held locked by a removable component, the improvement consisting in that the system includes switch means receiving said component to operate an electrical circuit inside the building, said switch means being maintained in a first switching condition when the component is received therein and in a second switching condition when the component is removed therefrom to be positioned to lock the door.

2. The system according to claim 1 wherein the door is provided with bolt means adapted to hold the door closed, and said component is adapted, when fitted to the door, to prevent withdrawal of said bolt means.

3. The system according to claim 2 wherein the bolt means includes an actuating mechanism operable by a push rod.

4. The system according to claim 3 wherein the bolt means comprises panic bolts.

5. The system according to claim 3 wherein said component is a plate slotted to engage said push rod to prevent actuating movement thereof withdrawing the bolt means.

6. The system according to claim 1 comprising a casing spaced from the door and adapted to receive the said component and including electric switch means operable by location of the said component in the casing to complete the electrical circuit.

7. A door-locking and release system for a door in a building, which system comprises bolt means adapted to hold the door in a closed position;

a removable component to prevent withdrawal of said bolt means from its closed position; and an electrical alarm circuit including switch means receiving said component, said switch means being maintained in a first switching condition when the component is received therein and in a second switching condition when the component is removed therefrom to be positioned to prevent withdrawal of the bolt means from its closed position.

8. The system according to claim 7 in which the bolt means includes an actuating member operable by a push rod and the said component is a plate slotted to engage said push rod to prevent actuating movement thereof withdrawing the bolt means.

9. The system according to claim 8 wherein the switch means is located in a casing spaced from the door and adapted to receive the plate in a switch actuating position.

10. The system according to claim 7 wherein the alarm circuit is energised by switching on a lighting circuit in the building.

11. The system according to claim 7 wherein the bolt means comprises a pair of reciprocable elongate bolt members; link members pivotally attached to said bolt members; a rotatable actuating member pivotally attached to said link members, a lever rotatable with said rotatable members and a reciprocable push rod acting on said lever, said push rod having a circumferential groove, and the said component is a plate slotted to engage said groove and thereby to restrain the push rod from movement at least when the bolt means is in its closed, i.e. holding, position.

12. The system according to claim 11 wherein the said link members, rotatable actuating members and lever are all enclosed within a casing through which the push rod extends and said plate is adapted to be secured to an outer wall of the casing.

* * * * *